US011802390B2

(12) United States Patent
Jung et al.

(10) Patent No.: US 11,802,390 B2
(45) Date of Patent: Oct. 31, 2023

(54) HYDRAULIC MACHINERY

(71) Applicant: VOLVO CONSTRUCTION EQUIPMENT AB, Eskilstuna (SE)

(72) Inventors: Taerang Jung, Gyeongsangnam-do (KR); Sangmin Gwon, Gyeongsangnam-do (KR); Sangki Bae, Gyeongsangnam-do (KR); Dongsoo Kim, Gyeongsangnam-do (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 47 days.

(21) Appl. No.: 17/601,183

(22) PCT Filed: Apr. 5, 2019

(86) PCT No.: PCT/KR2019/004094
§ 371 (c)(1),
(2) Date: Oct. 4, 2021

(87) PCT Pub. No.: WO2020/204237
PCT Pub. Date: Oct. 8, 2020

(65) Prior Publication Data

US 2022/0186460 A1 Jun. 16, 2022

(51) Int. Cl.

| | |
|---|---|
| ***E02F 9/22*** | (2006.01) |
| ***F15B 21/14*** | (2006.01) |
| ***E02F 3/43*** | (2006.01) |

(52) U.S. Cl.
CPC ..... *E02F 3/435* (2013.01); *E02F 9/2217* (2013.01); *E02F 9/2225* (2013.01);
(Continued)

(58) Field of Classification Search
CPC ..... F15B 1/021; F15B 1/024; F15B 21/008; F15B 21/14; E02F 9/2217
See application file for complete search history.

(56) References Cited

U.S. PATENT DOCUMENTS 9,593,467 B2 * 3/2017 Kajita ..... E02F 9/2292
9,938,691 B2 4/2018 Hiraku
(Continued)

FOREIGN PATENT DOCUMENTS

CN 105940356 A 9/2016
CN 104903595 A 3/2017
(Continued)

OTHER PUBLICATIONS

International Search Report and Written Opinion of the International Searching Authority, PCT/KR2019/004094, dated Jan. 3, 2020, 10 pages.
(Continued)

*Primary Examiner* — Michael Leslie
(74) *Attorney, Agent, or Firm* — Sage Patent Group

(57) ABSTRACT

A hydraulic machinery may include: a boom actuator including a large chamber and a small chamber; a tank; and an energy recovery circuit provided between the boom actuator and the tank, wherein the energy recovery circuit includes: a discharge valve provided between the large chamber and the tank to allow or block the flow of fluid from the former to the latter; a regeneration valve connecting the large chamber and the small chamber to allow or block the flow of fluid from the former to the latter; a recovery part for recovering energy; and a first valve provided between the large chamber and the recovery part to allow or block the flow of fluid from the former to the latter.

12 Claims, 4 Drawing Sheets

(52) U.S. Cl.
CPC ..... *E02F 9/2267* (2013.01); *E02F 9/2285* (2013.01); *E02F 9/2292* (2013.01); *F15B 21/14* (2013.01)

(56) References Cited

U.S. PATENT DOCUMENTS

| | | | | |
|---|---|---|---|---|
| 9,945,396 | B2 * | 4/2018 | Shang | F15B 21/14 |
| 10,174,770 | B2 * | 1/2019 | Zhang | F15B 13/021 |
| 10,407,876 | B2 | 9/2019 | Joo et al. | |
| 10,494,791 | B2 | 12/2019 | Kang et al. | |
| 10,704,229 | B2 * | 7/2020 | Uemura | F15B 21/14 |
| 11,401,693 | B2 * | 8/2022 | Kim | F15B 1/024 |
| 2007/0033933 | A1 | 2/2007 | Bitter | |
| 2017/0016460 | A1 | 1/2017 | Jung et al. | |
| 2017/0363122 | A1 * | 12/2017 | Hahn | F15B 21/14 |

FOREIGN PATENT DOCUMENTS

| | | | |
|---|---|---|---|
| CN | 107250563 | A | 10/2017 |
| CN | 107683359 | A | 2/2018 |
| EP | 2589823 | A1 | 5/2013 |
| EP | 3176444 | A1 | 6/2017 |
| JP | 2009-250361 | A | 10/2009 |
| JP | 2016-205492 | A | 12/2016 |
| KR | 10-2017-0032417 | A | 3/2017 |
| KR | 10-2017-0139681 | A | 12/2017 |
| WO | WO 2016/169943 | A1 | 10/2016 |

OTHER PUBLICATIONS

Extended European Search Report, EP Application No. 19922356.1, dated Nov. 9, 2022, 10 pages.

* cited by examiner

HYDRAULIC MACHINERY

CROSS REFERENCE TO RELATED APPLICATIONS

This application is a 35 U.S.C. § 371 national stage application of PCT International Application No. PCT/KR2019/004094 filed on Apr. 5, 2019, the disclosure and content of which is incorporated by reference herein in its entirety.

TECHNICAL FIELD

The present disclosure relates to a hydraulic machine and, more particularly, to a hydraulic machine able to efficiently recover energy discharged from a boom actuator.

BACKGROUND ART

A hydraulic machine is an apparatus configured to carry out work by supplying high pressure fluid to (an actuator of) a working device. To improve the fuel efficiency of the hydraulic machine, a technology of recovering energy contained in fluid discharged from a boom actuator has been proposed. However, hydraulic machines of the related art do not have high energy recovery efficiency, and thus, there has been demand for improvements in recovery efficiency.

DISCLOSURE

Technical Problem

Accordingly, the present disclosure has been made in consideration of the above-described problems occurring in the related art, and the present disclosure is intended to improve energy recovery efficiency.

Technical Solution

In order to realize at least one of the above-described objectives, according to an aspect of the present disclosure, a hydraulic machine may include: a boom actuator including a large chamber and a small chamber; a tank; an energy recovery circuit provided between the boom actuator and the tank, the energy recovery circuit including: a drain valve provided between the large chamber and the tank to allow or block a flow of fluid from the large chamber to the tank; a regeneration valve connecting the large chamber and the small chamber to allow or block a flow of fluid from the large chamber to the small chamber; a recovery unit recovering energy; and a first valve provided between the large chamber and the recovery unit to allow or block a flow of fluid from the large chamber toward the recovery unit.

In some embodiments, in a boom-down operation, the drain valve may be operated to block the flow of fluid from the large chamber to the tank. In some embodiments, in the boom-down operation, the regeneration valve may be operated to allow the flow of fluid from the large chamber to the small chamber, and the first valve may be operated to allow the flow of fluid from the large chamber toward the recovery unit.

The hydraulic machine may further include an energy consumption circuit provided between the boom actuator and the tank. The energy consumption circuit may include: a pump; and a control valve provided between the boom actuator and the pump to allow or block a flow of fluid from the pump to the boom actuator and a flow of fluid from the boom actuator to the tank.

Advantageous Effects

According to embodiments, the present disclosure may obtain the above-described objectives.

MODE FOR INVENTION

Hereinafter, embodiments of the present disclosure will be described in detail with reference to the accompanying drawings.

Figure 1:
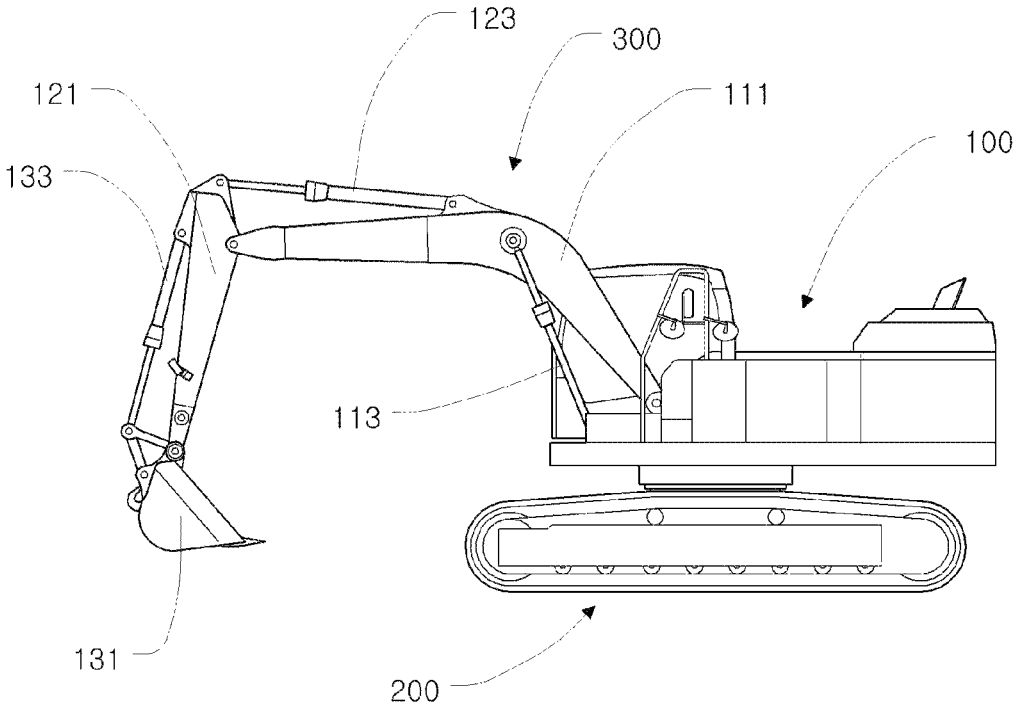
FIG. 1 is a schematic diagram illustrating an external appearance of a hydraulic machine according to some embodiments.

FIG. 1 is a schematic diagram illustrating an external appearance of a hydraulic machine according to some embodiments.

A hydraulic machine may carry out work by actuating a working device 300 using hydraulic pressure. In some embodiments, the hydraulic machine may be a construction machine.

In some embodiments, the hydraulic machine may be an excavator as illustrated in FIG. 1. The hydraulic machine may include an upper structure 100, an under structure 200, and the working device 300.

The under structure 200 includes a travel actuator allowing the hydraulic machine to travel. The travel actuator may be a hydraulic motor.

The upper structure 100 may include a pump, a working fluid tank, a power source, a control valve, and the like. In addition, the upper structure 100 may include a swing actuator allowing the upper structure 100 to rotate with respect to the under structure 200. The swing actuator may be a hydraulic motor.

The working device 300 allows the excavator to carry out work. The working device 300 may include a boom 111, an arm 121, and a bucket 131, as well as a boom actuator 113, an arm actuator 123, and a bucket actuator 133 actuating the boom 111, the arm 121, and the bucket 131, respectively. The boom actuator 113, the arm actuator 123, and the bucket actuator 133 may be hydraulic cylinders, respectively.

Figure 2:
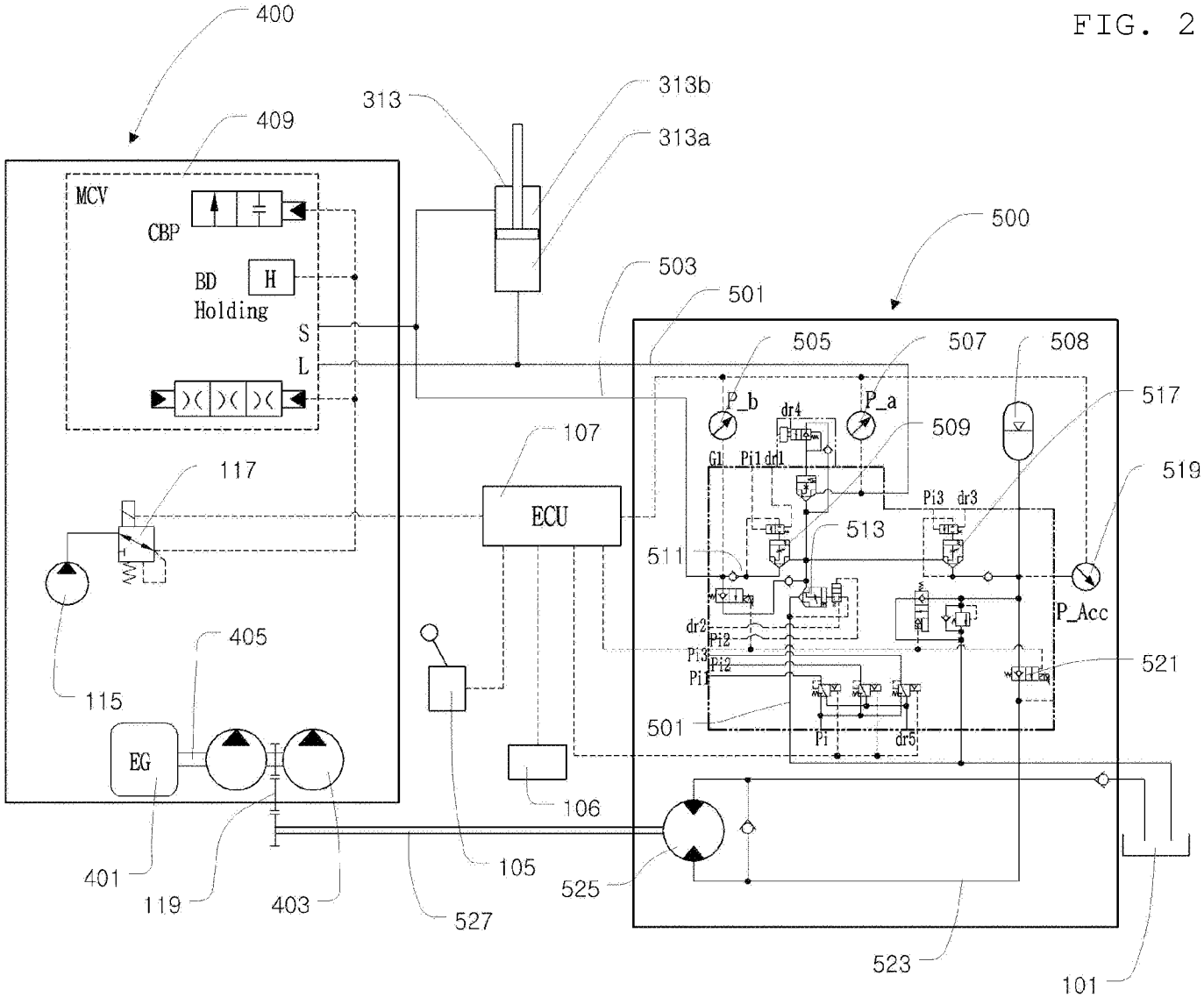
FIG. 2 is a circuit diagram illustrating a hydraulic machine according to some embodiments.

FIG. 2 is a circuit diagram illustrating a hydraulic machine according to some embodiments.

In some embodiments, the hydraulic machine may include the boom actuator 313, an energy recovery circuit 500, a tank 101, and a controller 107. The energy recovery circuit 500 may be provided between the boom actuator 313 and the tank 101. In some embodiments, the hydraulic machine may include an energy consumption circuit 400. The energy consumption circuit 400 may be provided between the boom actuator 313 and the tank 101.

The energy recovery circuit 500 may be connected to the boom actuator 313 to recover energy contained in fluid discharged from the boom actuator 313. In some embodiments, the energy recovery circuit 500 may include a drain valve 513, a regeneration valve 509, a first valve 517, and a recovery unit 525.

The energy consumption circuit 400 is a circuit connected to the boom actuator 313 to supply high pressure fluid to the boom actuator 313 and return the fluid discharged from the boom actuator 313 to the tank 101. In some embodiments, the energy consumption circuit 400 may include a power source 401, a main pump, and a control valve 409. The main pump may direct pressurized fluid to the boom actuator 313. The power source 401 may drive the pump. In some embodiments, the power source 401 may include an engine.

In some embodiments, the hydraulic machine may be configured to actuate the working device using the energy consumption circuit 400 at normal time and recover energy using the energy recovery circuit 500 when a hybrid function is intended to be performed.

In some embodiments, the power source 401 may drive the main pump by supplying power to the main pump through a main shaft 405. The main pump may pressurize fluid and direct the pressurized fluid to the boom actuator 313. The boom actuator 313 may receive the pressurized fluid from the main pump and return fluid toward the tank 101. The boom actuator 313 may actuate the boom by providing the force of the pressurized fluid received from the main pump to the boom.

In some embodiments, the boom actuator 313 may be a hydraulic cylinder, and may include a large chamber 313*a* and a small chamber 313*b*. Since a piston rod connected to the boom extends through the small chamber 313*b*, an area on which the fluid inside the small chamber 313*b* is in contact with the piston is smaller than an area on which the fluid inside the large chamber 313*a* is in contact with the piston, due to the area occupied by the piston rod. Also referring to FIG. 1, in a boom down operation in which the boom is lowered, the piston rod is also lowered. Consequently, fluid enters the small chamber 313*b*, while fluid is discharged from the large chamber 313*a*.

The control valve 409 may connect the main pump, the tank 101, and the boom actuator 313 to control the directions of flows of fluid therebetween. In some embodiments, the control valve 409 may be moved to a neutral position, a first non-neutral position, or a second non-neutral position. When the control valve 409 is in the neutral position, the control valve 409 may be operated not to fluidly communicate with the boom actuator 313 and return the fluid that has flowed from the main pump to the tank 101 through a central bypass path. When the control valve 409 is in the first non-neutral position, the control valve 409 may prevent the fluid that has flowed from the main pump from returning to the tank 101 through the central bypass path, direct the fluid that has flowed from the main pump to the small chamber 313*b*, and direct the fluid that has flowed from the large chamber 313*a* to the tank 101, thereby moving the boom down. When the control valve 409 is in the second non-neutral position, the control valve 409 may prevent the fluid that has flowed from the main pump from returning to the tank 101 through the central bypass path, direct the fluid that has flowed from the main pump to the large chamber 313*a*, and direct the fluid that has flowed from the small chamber 313*b* to the tank 101, thereby moving the boom up.

In some embodiments, the hydraulic machine may include a first operator input device 105 to move the control valve 409. An operator may input his/her request to raise or lower the boom by operating the first operator input device 105. Although in some embodiments, the first operator input device 105 may be a lever, the present disclosure is not limited thereto.

In some embodiments, the first operator input device 105 may be an electrical input device, and may generate an electrical signal corresponding to the operator's request and transmit the electrical signal to the controller 107. In some embodiments, the hydraulic machine may include a pilot pump 115 and an electronic proportional pressure reducing valve 117. When receiving an electrical signal from the first operator input device 105, the controller 107 may responsively operate the electronic proportional pressure reducing valve 117 by transmitting a control signal to the electronic proportional pressure reducing valve 117. When the electronic proportional pressure reducing valve 117 is in a first position, the electronic proportional pressure reducing valve 117 may operate the control valve 409 by directing pilot fluid that has flowed from the pilot pump 115 to the control valve 409. When the electronic proportional pressure reducing valve 117 is in a second position, the electronic proportional pressure reducing valve may prevent the pilot fluid from flowing from the pilot pump 115 to the control valve 409 and allow the pilot fluid provided to the control valve 409 to drain.

The drain valve 513 may be provided between the large chamber 313*a* and the tank 101 to allow or block a flow of fluid from the large chamber 313*a* to the tank 101. The regeneration valve 509 may connect the large chamber 313*a* and the small chamber 313*b* to allow or block a flow of fluid from the large chamber 313*a* to the small chamber 313*b*. The first valve 517 may be provided between the large chamber 313*a* and the recovery unit 525 to allow or block a flow of fluid from the large chamber 313*a* toward the recovery unit 525.

The recovery unit 525 is a component recovering power. In some embodiments, the recovery unit 525 may be a hydraulic motor (e.g., an assist motor). The assist motor may assist the power source 401 by providing the recovered power for the power source 401. In this regard, in some embodiments, the hydraulic machine may include a power transmission. The power transmission may be connected to a pump, the power source 401, and the assist motor to deliver power therebetween. In some embodiments, the power transmission may include the main shaft 405 connecting the power source and the pump, an assist shaft 527 connected to the assist motor, and a power transmission part 119. In some embodiments, the power transmission part 119 may include a gear train as illustrated in FIG. 2. However, the present disclosure is not limited thereto and may include a variety of other embodiments.

In some embodiments, the hydraulic machine may include a second operator input device 106 configured to receive a request input by the operator to activate or deactivate a hybrid function. When the request to activate the hybrid function is input to the second operator input device 106, the controller 107 may control the electronic proportional pressure reducing valve 117 so that the pilot fluid is not supplied to the control valve 409. In this manner, the controller 107 may move the control valve 409 to the neutral position, thereby preventing a flow of fluid between the boom actuator 313 and the energy consumption circuit 400. Thus, in a situation in which the hybrid function is activated, the boom down operation may only be induced by the weight thereof without the supply of the pressure fluid by the pump. When a request to deactivate the hybrid function is input to the second operator input device 106, the controller 107 may prevent a flow of fluid between the boom actuator 313 and the energy recovery circuit 500 by moving the drain valve 513, the regeneration valve 509, and the first valve 517.

In some embodiments, in the boom down operation in which the boom is lowered, the drain valve 513 may be operated to block a flow of fluid from the large chamber 313*a* to the tank 101. In the boom down operation, the regeneration valve 509 may be operated to allow a flow of fluid from the large chamber 313*a* to the small chamber 313*b*. In the boom down operation, the first valve 517 may be operated to allow a flow of fluid from the large chamber 313*a* to the recovery unit 525

In the boom down operation, when the regeneration valve 509 is opened, regeneration is performed. At this time, when the drain valve 513 is not opened, since the overall amount of the fluid discharged from the large chamber 313*a* of the boom actuator 313 cannot enter the small chamber 313*b* and the load applied to the working device is added, the overall pressure in the hydraulic circuit is increased. In this manner, the overall pressure in the energy recovery circuit 500 is increased using this physical phenomenon (i.e., pressure boosting) (for example, by the effective area ratio (e.g., about 1:2) between the large chamber 313*a* and the small chamber 313*b*) When the pressure is increased, the power is also increased according to the formula: power=pressure X flow rate. Consequently, higher power may be obtained with the same flow rate, and thus, the following advantages may be obtained.

For example, in the boom down operation, the pressure is typically controlled to be about 100 bars. The velocity, i.e., the flow rate, of the boom actuator 313 at this time is about 300 Lpm, from which the power may be calculated to be about 50 KW. When the pressure is increased to be about 200 bars, higher power of 100 KW may be obtained with the same flow rate.

Consequently, higher power may be obtained with the accumulator 508 having a limited size, and a greater energy recovery ratio may be obtained in a short operation time of the boom actuator 313. Thus, the amount of the fluid supplied to the assist motor may be reduced, and thereby, the size of the motor can be reduced. Accordingly, the costs for the accumulator 508 and the motor may be reduced.

In some embodiments, the energy recovery circuit 500 may include a first line 501 and a second line 503. The first line 501 may connect the large chamber 313*a* and the tank 101 to allow a flow of fluid from the large chamber 313*a* to the tank 101. The second line 503 may be connected to the small chamber 313*b*.

In some embodiments, the drain valve 513 may be provided on the first line 501 to allow or block the flow of fluid from the large chamber 313*a* to the tank 101 through the first line 501. In some embodiments, the regeneration valve 509 may be connected to the first line 501 at a location between the large chamber 313*a* and the drain valve 513, and connected to the second line 503 to allow or block a flow of fluid from the first line 501 to the second line 503.

In some embodiments, the energy recovery circuit 500 may include a recovery line 523 connecting the large chamber 313*a* and the recovery unit 525. In some embodiments, the recovery line 523 may be connected to the first line 501 at a location between the large chamber 313*a* and the drain valve 513, and connected to the recovery unit 525 to allow a flow of fluid from the first line 501 to the recovery unit 525. In some embodiments, the first valve 517 may be provided on the recovery line 523. The first valve 517 may allow or block the flow of fluid from the first line 501 toward the recovery unit 525 through the recovery line 523.

In some embodiments, the energy recovery circuit 500 may include a second valve 521 provided on the recovery line 523. The second valve 521 may allow or block a flow of fluid from the first valve 517 to the recovery unit 525. In the boom down operation, the second valve 521 may be operated to allow a flow of fluid to the recovery unit 525.

Figure 4:
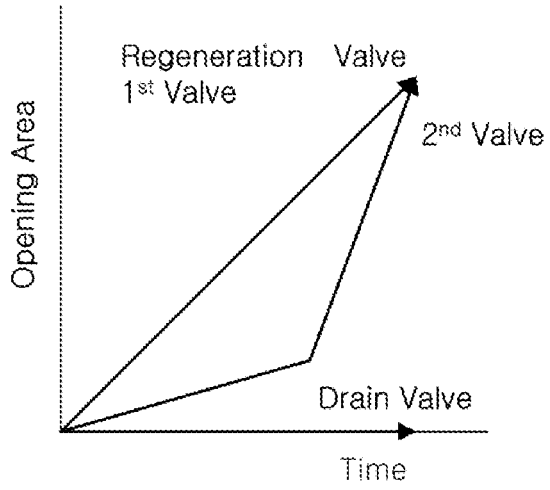
FIG. 4 is a graph illustrating opening areas of the regeneration value, the first valve, the second valve, and drain valve in a hydraulic machine according to some embodiments in a boom down operation.

In some embodiments, in the boom down operation, the controller 107 may control the opening areas of the regeneration valve 509, the first valve 517, the second valve 521, and the drain valve 513, respectively, as illustrated in FIG. 4. In the boom down operation, about half of a high-pressure flow rate discharged from the large chamber 313*a* is regenerated by means of the regeneration valve 509, and the remaining amount of the flow rate flows through the first valve 517 and then, is stored in the accumulator 508. The stored flow rate flows through the second valve 521 and then, is supplied to a recovery unit 525. Here, whether or not the boom down energy is to be lost is determined depending on how much opening areas the regeneration valve 509, the first valve 517, and the second valve 521 are controlled to have. In some embodiments, in the boom down operation (i.e., when receiving a boom down operation request input by the operator through the first operator input device 105), the controller 107 may open the regeneration valve 509 and the first valve 517 to the maximum extent to minimize pressure loss and close the drain valve 513. In addition, in an early stage of the boom down operation (i.e., when receiving the boom down operation request input by the operator through the first operator input device 105), the controller 107 may control the opening area of the second valve 521 to be smaller than the opening area of the regeneration valve 509 and the opening area of the first valve 517, in consideration of essential loss in the assist motor. Afterwards, the controller 107 may control the second valve 521 to be opened to the maximum extent to be consistent with the characteristics of the boom down operation.

In some embodiments, the energy recovery circuit 500 may further include the accumulator 508 connected to the recovery line 523 at a location between the first valve 517 and the second valve 521.

In some embodiments, the hydraulic machine may include a first sensor 507 measuring a first pressure in the large chamber 313*a* and a second sensor 505 measuring a second pressure in the small chamber 313*b*.

Reference numeral 511 that has not been described hereinbefore indicates a valve, while reference numeral 519 that has not been described hereinbefore indicates a pressure sensor.

Figure 3:
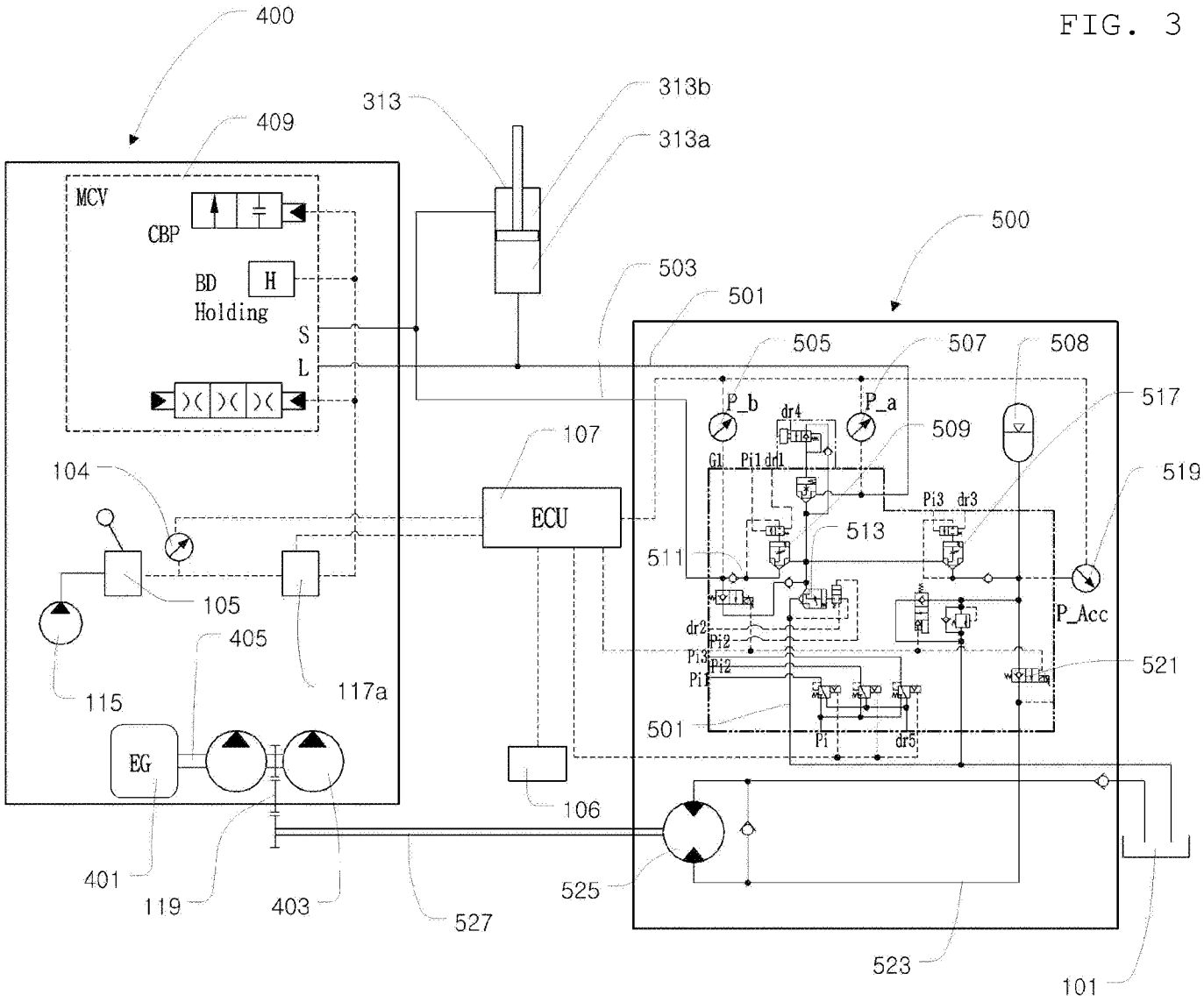
FIG. 3 is a circuit diagram illustrating a hydraulic machine according to some embodiments.

FIG. 3 is a circuit diagram illustrating a hydraulic machine according to some embodiments.

In some alternative embodiments, the first operator input device 105 may be a hydraulic input device including a built-in pressure reducing valve (not shown), and the hydraulic machine may include an auxiliary valve 117*a*. In these embodiments, the pilot pump 115 may be connected to the pressure reducing valve of the first operator input device 105, and the pressure reducing valve may transmit a hydraulic signal corresponding to the operator's request input through the first operator input device 105 to the auxiliary valve 117*a*. In some embodiments, the hydraulic machine may include a sensor measuring the pressure of the hydraulic signal transmitted to the auxiliary valve 117*a* by the pressure reducing valve, and the sensor may generate an electrical signal corresponding to the hydraulic signal and provide the electrical signal to the controller 107. Thus, even in the case that the controller 107 is not directly connected to the first operator input device 105, the controller 107 may determine what request has been input by the operator, i.e., whether a boom down operation request is input or a boom up operation request is input. When a request to deactivate the hybrid function is input through the second operator input device 106, a hydraulic signal generated by the first operator input device 105 may be transmitted to the control valve 409 through the auxiliary valve 117*a*. However, when the request to activate the hybrid function is input through the second operator input device 106, the controller 107 may control the auxiliary valve 117*a* so that the pilot fluid is not supplied to the control valve 409. In this manner, the controller 107 may move the control valve 409 to the neutral position, thereby preventing fluid from flowing #between the boom actuator 313 and the energy consumption circuit 400.

The invention claimed is:

1. A hydraulic machine comprising:

a boom actuator configured to actuate a boom, the boom actuator comprising a large chamber and a small chamber;

a tank; and an energy recovery circuit provided between the boom actuator and the tank, the energy recovery circuit comprising:

a drain valve provided between the large chamber and the tank to allow or block a flow of fluid from the large chamber to the tank;

a regeneration valve connecting the large chamber and the small chamber to allow or block a flow of fluid from the large chamber to the small chamber;

a recovery unit recovering energy;

a first valve provided between the large chamber and the recovery unit to allow or block a flow of fluid from the large chamber toward the recovery unit;

a recovery line connecting the large chamber and the recovery unit;

a second valve provided on the recovery line to allow or block a flow of fluid to the recovery unit; and an accumulator connected to the recovery line, wherein the first valve is provided on the recovery line, wherein the second valve is provided between the first valve and the recovery unit, and wherein the accumulator is connected to the recovery line at a location between the first valve and the second valve, wherein, in a boom-down operation in which the boom is lowered:

the drain valve is closed to block the flow of fluid from the large chamber to the tank, the regeneration valve is opened to allow the flow of fluid from the large chamber to the small chamber, the first valve is opened to allow the flow of fluid from the large chamber toward the recovery unit, and the second valve is opened to allow a flow of fluid to the recovery unit, and, wherein, in an early stage of the boom-down operation, an opening area of the second valve is smaller than an opening area of the regeneration valve and an opening area of the first valve.

2. The hydraulic machine of claim 1, wherein, in the boom-down operation, the drain valve is operated to block the flow of fluid from the large chamber to the tank.

3. The hydraulic machine of claim 1, wherein, in the boom-down operation, the regeneration valve is operated to allow the flow of fluid from the large chamber to the small chamber, and the first valve is operated to allow the flow of fluid from the large chamber toward the recovery unit.

4. The hydraulic machine of claim 1, further comprising an energy consumption circuit provided between the boom actuator and the tank, the energy consumption circuit comprising:

a pump; and a control valve provided between the boom actuator and the pump to allow or block a flow of fluid from the pump to the boom actuator and a flow of fluid from the boom actuator to the tank.

5. The hydraulic machine of claim 4, further comprising a second operator input device configured to receive at least one of:

a first operator's request to block a flow of fluid between the boom actuator and the energy consumption circuit, and a second operator's request to block a flow of fluid between the boom actuator and the energy recovery circuit.

6. The hydraulic machine of claim 5, wherein, when the first operator's request is input to the second operator input device, the control valve is operated to block the flow of fluid between the boom actuator and the energy consumption circuit, and when the second operator's request is input to the second operator input device, the drain valve, the regeneration valve, and the first valve are operated to block the flow of fluid between the boom actuator and the energy recovery circuit.

7. The hydraulic machine of claim 6, further comprising:

a first operator input device configured to receive a third operator's request to operate the boom actuator and, in response to the third operator's request, generating a pilot hydraulic signal for operating the control valve; and an auxiliary valve provided between the first operator input device and the control valve to allow the pilot hydraulic signal generated by the first operator input device to be applied to the control valve or prevent the pilot hydraulic signal generated by the first operator input device from being applied to the control valve, wherein, when the first operator's request is input to the second operator input device, the auxiliary valve is operated to prevent the pilot hydraulic signal from being applied to the control valve.

8. The hydraulic machine of claim 1, further comprising a second operator input device configured to receive at least one of:

a first operator's request to block a flow of fluid between the boom actuator and the energy consumption circuit, and a second operator request to block a flow of fluid between the boom actuator and the energy recovery circuit.

9. The hydraulic machine of claim 8, wherein, when the second operator's request is input to the second operator input device, the drain valve, the regeneration valve, and the first valve are operated to block the flow of fluid between the boom actuator and the energy recovery circuit.

10. The hydraulic machine of claim 1, wherein the energy recovery circuit further comprises:

a first line connecting the large chamber and the tank to allow the flow of fluid from the large chamber to the tank;

a second line connected to the small chamber, and wherein the drain valve is provided on the first line to allow or block the flow of fluid from the large chamber to the tank, the regeneration valve is connected to the first line at a location between the large chamber and the drain valve, and connected to the second line to allow or block a flow of fluid from the first line to the second line, the recovery line is connected to the first line at a location between the large chamber and the drain valve, and connected to the recovery unit to allow a flow of fluid from the first line toward the recovery unit, and the first valve is provided on the recovery line to allow or block the flow of fluid from the first line toward the recovery unit.

11. The hydraulic machine of claim 1, wherein, in the boom-down operation, the second valve is operated to allow the flow of fluid to the recovery unit.

12. The hydraulic machine of claim 1, wherein the recovery unit is a hydraulic motor, the hydraulic machine further comprising:

a pump directing pressurized fluid to the boom actuator;

a power source driving the pump; and a power transmission connected to the pump, the power source, and the hydraulic motor to transmit power between the power source, the hydraulic motor, and the pump.

* * * * *